US010424844B2

(12) United States Patent
Lee et al.

(10) Patent No.: US 10,424,844 B2
(45) Date of Patent: Sep. 24, 2019

(54) ELECTRONIC DEVICE

(71) Applicant: Chiun Mai Communication Systems, Inc., New Taipei (TW)

(72) Inventors: Kwang-Pi Lee, New Taipei (TW); Wei-Ting Cheng, New Taipei (TW); Yen-Hui Lin, New Taipei (TW); Szu-Tso Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 14 days.

(21) Appl. No.: 15/838,369

(22) Filed: Dec. 12, 2017

(65) Prior Publication Data

US 2018/0191077 A1 Jul. 5, 2018

(30) Foreign Application Priority Data

Jan. 5, 2017 (CN) ..... 2017 1 0007308

(51) Int. Cl.

| | |
|---|---|
| ***H01Q 13/10*** | (2006.01) |
| ***H01Q 1/52*** | (2006.01) |
| ***H01Q 1/24*** | (2006.01) |
| *H01Q 1/48* | (2006.01) |

(52) U.S. Cl.

CPC ..... *H01Q 13/10* (2013.01); *H01Q 1/243* (2013.01); *H01Q 1/521* (2013.01); *H01Q 1/48* (2013.01)

(58) Field of Classification Search

CPC ..... H01Q 13/10; H01Q 1/243; H01Q 1/521; H01Q 1/48

USPC ..... 343/721

See application file for complete search history.

(56) References Cited

U.S. PATENT DOCUMENTS

| | | | | |
|---|---|---|---|---|
| 7,158,083 | B2 * | 1/2007 | Satoh | H01Q 1/084 343/702 |
| 9,190,713 | B2 * | 11/2015 | Eom | H01Q 1/243 |
| 9,509,042 | B1 | 11/2016 | Zheng et al. | |
| 9,991,586 | B2 * | 6/2018 | Hsu | H01Q 1/241 |
| 10,069,194 | B2 * | 9/2018 | Cai | H01Q 1/243 |
| 2014/0333494 | A1 | 11/2014 | Huang | |

* cited by examiner

*Primary Examiner* — Brian K Young
(74) *Attorney, Agent, or Firm* — ScienBiziP, P.C.

(57) ABSTRACT

An electronic device includes a housing. The housing defines a slot and a groove communicating with the slot. The housing is divided into at least a first radiating portion and a second radiating portion by the slot and the groove. The first radiating portion is spaced apart from the second radiating portion. The first radiating portion and the second radiating portion cooperatively serve as an antenna structure of the electronic device to receive and/or transmit wireless signals. The electronic device further performs a predetermined function through the groove.

20 Claims, 5 Drawing Sheets

ELECTRONIC DEVICE

CROSS-REFERENCE TO RELATED APPLICATIONS

This application claims priority to Chinese Patent Application No. 201710007308.2 filed on Jan. 5, 2017, the contents of which are incorporated by reference herein.

FIELD

The subject matter herein generally relates to an electronic device using the antenna structure.

BACKGROUND

Antennas are important components in wireless communication devices for receiving and transmitting wireless signals at different frequencies, such as signals in Long Term Evolution Advanced (LTE-A) frequency bands. However, the structure of the antenna is complicated and occupies a large space in the wireless communication device, which is inconvenient for miniaturization of the wireless communication device.

BRIEF DESCRIPTION OF THE DRAWINGS

Implementations of the present technology will now be described, by way of example only, with reference to the attached figures.

DETAILED DESCRIPTION

Figure 1:
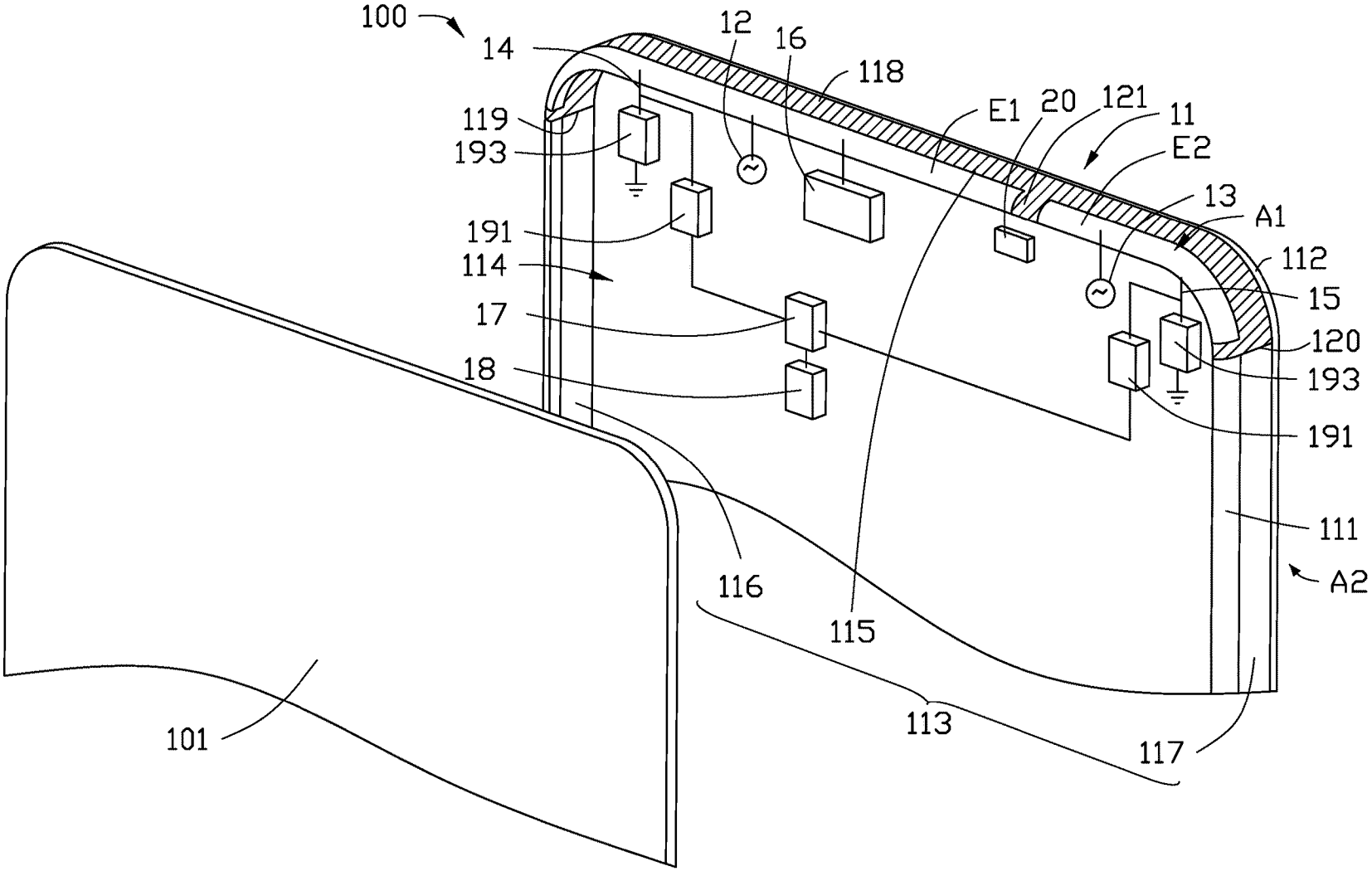
FIG. 1 is an isometric view of a first exemplary embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an electronic device.

Figure 2:
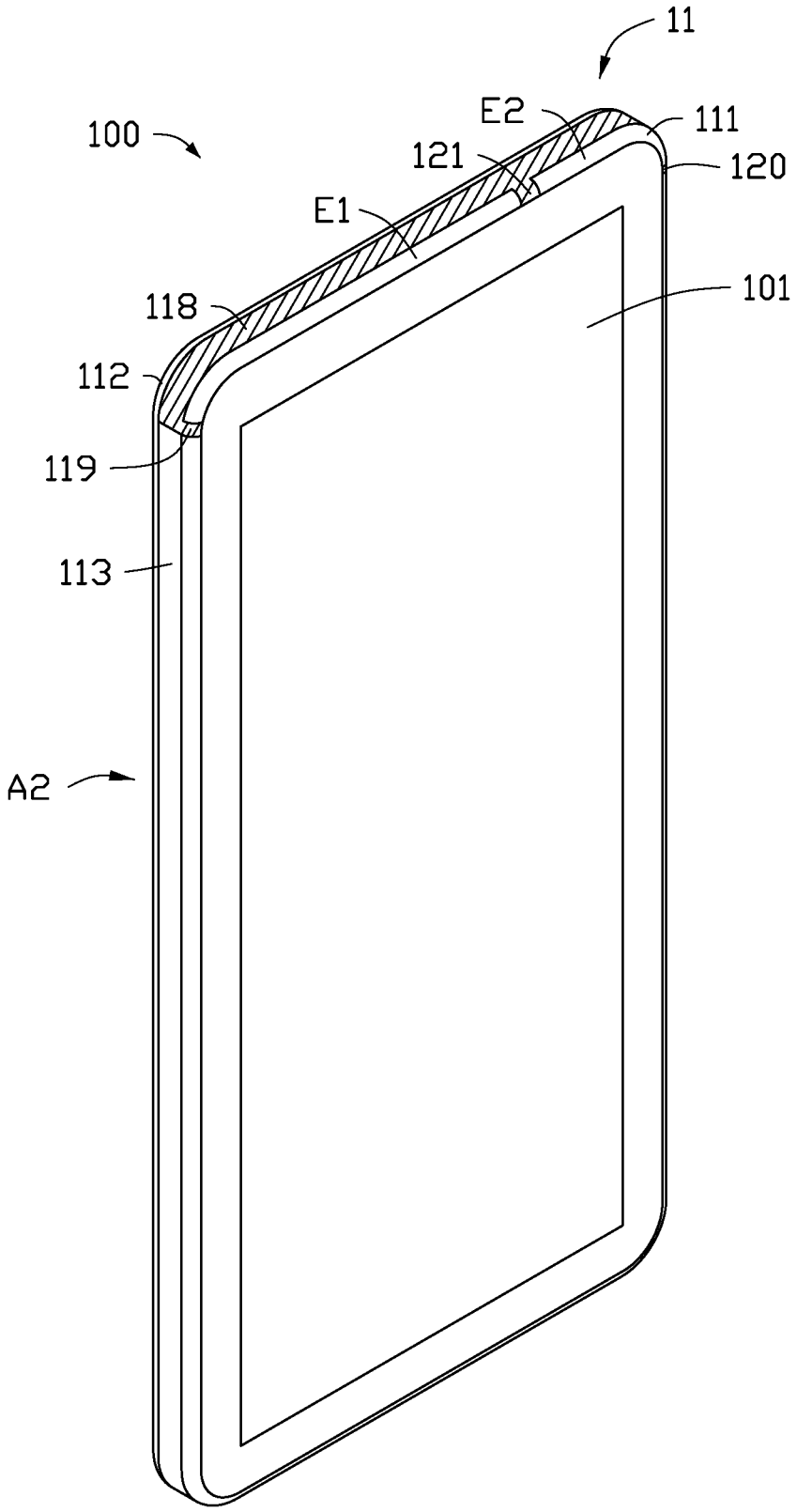
FIG. 2 is similar to FIG. 1, but shown from another angle.

FIG. 1 and FIG. 2 illustrate an exemplary embodiment of an electronic device 100. The electronic device 100 can be a mobile phone or a personal digital assistant, for example. The electronic device 100 includes a housing 11, a first feed source 12, a second feed source 13, a first ground portion 14, and a second ground portion 15.

The housing 11 houses the electronic device 100. In this exemplary embodiment, the housing 11 is made of metallic material. The housing 11 includes a front frame 111, a backboard 112, and a side frame 113. The front frame 111, the backboard 112, and the side frame 113 can be integral with each other. The front frame 111, the backboard 112, and the side frame 113 cooperatively form the metallic housing of the electronic device 100.

The front frame 111 defines an opening (not shown). The electronic device 100 includes a display 101. The display 101 is received in the opening. The display 101 has a display surface. The display surface is exposed at the opening and is positioned parallel to the backboard 112.

The backboard 112 is positioned opposite to the front frame 111. The side frame 113 is positioned between the front frame 111 and the backboard 112. The side frame 113 is positioned around a periphery of the front frame 111 and a periphery of the backboard 112. The side frame 113 forms a receiving space 114 together with the display 101, the front frame 111, and the backboard 112. The receiving space 114 can receive a print circuit board, a processing unit, or other electronic components or modules.

The side frame 113 includes an end portion 115, a first side portion 116, and a second side portion 117. The end portion 115 can be a top portion or a bottom portion of the electronic device 100. The end portion 115 connects the front frame 111 and the backboard 112. The first side portion 116 is positioned apart from and parallel to the second side portion 117. The end portion 115 has first and second ends. The first side portion 116 is connected to the first end of the first frame 111 and the second side portion 117 is connected to the second end of the end portion 115. The first side portion 116 connects the front frame 111 and the backboard 112. The second side portion 117 also connects the front frame 111 and the backboard 112.

The side frame 113 defines a slot 118. The front frame 111 defines a first gap 119, a second gap 120, and a groove 121. In this exemplary embodiment, the slot 118 is defined at the end portion 115 and extends to the first side portion 116 and the second side portion 117.

The first gap 119, the second gap 120, and the groove 121 are all in communication with the slot 118 and extend across the front frame 111. In this exemplary embodiment, the first gap 119 is positioned on the front frame 111 and communicates with a first end of the slot 118 positioned on the first side portion 116. The second gap 120 is positioned on the front frame 111 and communicates with a second end of the slot 118 positioned on the second portion 117. The housing 11 is divided into two portions by the slot 118, the first gap 119, and the second gap 120, that is, a first portion A1 and a second portion A2. A portion of the housing 11 surrounded by the slot 118, the first gap 119, and the second gap 120 forms the first portion A1. The other portion of the housing 11 forms the second portion A2. In this exemplary embodiment, the first portion A1 forms an antenna structure of the electronic device 100 to receive and/or transmit wireless signals. The second portion A2 is grounded.

In this exemplary embodiment, the slot 118 is defined at the end of the side frame 113 adjacent to the backboard 112 and extends to an edge of the front frame 111. Then the first portion A1 is fully formed by a portion of the front frame 111. In other exemplary embodiments, a position of the slot 118 can be adjusted. For example, the slot 118 can be defined on the end of the side frame 113 adjacent to the backboard 112 and extend towards the front frame 111. Then the first portion A1 is formed by a portion of the front frame 111 and a portion of the side frame 113.

In other exemplary embodiments, the slot 118 is defined only at the end portion 115 and does not extend to any one of the first side portion 116 and the second side portion 117. In other exemplary embodiments, the slot 118 can be defined at the end portion 115 and extends to one of the first side portion 116 and the second side portion 117. Then, locations of the first gap 119 and the second gap 120 can be adjustable according to a position of the slot 118. For example, the first gap 119 and the second gap 120 are both positioned at a location of the front frame 111 corresponding to the end portion 115. For example, one of the first gap 119 and the second gap 120 is positioned at a location of the front frame 111 corresponding to the end portion 115. The other one of the first gap 119 and the second gap 120 is positioned at a location of the front frame 111 corresponding to the first side portion 116 or the second side portion 117. That is, a shape and a location of the slot 118, locations of the first gap 119 and the second gap 120 on the side frame 113 can be adjusted, to ensure that the housing 11 can be divided into the first portion A1 and the second portion A2 by the slot 118, the first gap 119, and the second gap 120.

In this exemplary embodiment, the groove 121 is defined on the first portion A1. The groove 121 is positioned between the first gap 119 and the second gap 120. The groove 121 is in communication with the slot 118 and extends across the first portion A1. In this exemplary embodiment, the groove 121 is positioned adjacent to the second side portion 117. The first portion A1 is divided into two portions by the groove 121, that is, a first radiating portion E1 and a second radiating portion E2. A first portion of the front frame 111 between the first gap 119 and the groove 121 forms the first radiating portion E1. A second portion of the front frame 111 between the second gap 120 and the groove 121 forms the second radiating portion E2.

In this exemplary embodiment, the groove 121 is not positioned at a middle portion of the first portion A1. The first radiating portion E1 is longer than the second radiating portion E2. In this exemplary embodiment, the slot 118, the first gap 119, the second gap 120, and the groove 121 are all filled with insulating material, for example, plastic, rubber, glass, wood, ceramic, or the like, thereby isolating the first radiating portion E1, the second radiating portion E2, and the other parts of the housing 11.

The first feed source 12 is electrically connected to the first radiating portion E1 for supplying current to the first radiating portion E1. The second feed source 13 is electrically connected to the second radiating portion E2 for supplying current to the second radiating portion E2. The first ground portion 14 is positioned at a location of the first radiating portion E1 adjacent to the first gap 119. One end of the first ground portion 14 is electrically connected to the first radiating portion E1. Another end of the first ground portion 14 is electrically connected to a ground system of the electronic device 100 to ground the first radiating portion E1. The second ground portion 15 is positioned at a location of the second radiating portion E2 adjacent to the second gap 120. One end of the second ground portion 15 is electrically connected to the second radiating portion E2. Another end of the second ground portion 15 is electrically connected to the ground system of the electronic device 100 to ground the second radiating portion E2.

When the first feed source 12 outputs current, the current flows through the first radiating portion E1 and is grounded through the first ground portion 14 so that the first radiating portion E1 activates a first operation mode to generate radiation signals in a first frequency band. In this exemplary embodiment, the first operation mode is a low and middle frequency operation mode.

When the second feed source 13 outputs current, the current flows through the second radiating portion E2 and is grounded through the second ground portion 15 so that the second radiating portion E2 activates a second operation mode to generate radiation signals in a second frequency band. In this exemplary embodiment, the second operation mode is a high frequency operation mode. A frequency of the first frequency band is lower than a frequency of the second frequency band.

In other exemplary embodiments, the electronic device 100 further includes a switching circuit 16. The switching circuit 16 is used to adjust a bandwidth of the first frequency band and the electronic device 100 has a good performance at the low and high frequency bands. One end of the switching circuit 16 is electrically connected to the first radiating portion E1. Another end of the switching circuit 16 is grounded.

Figure 3:
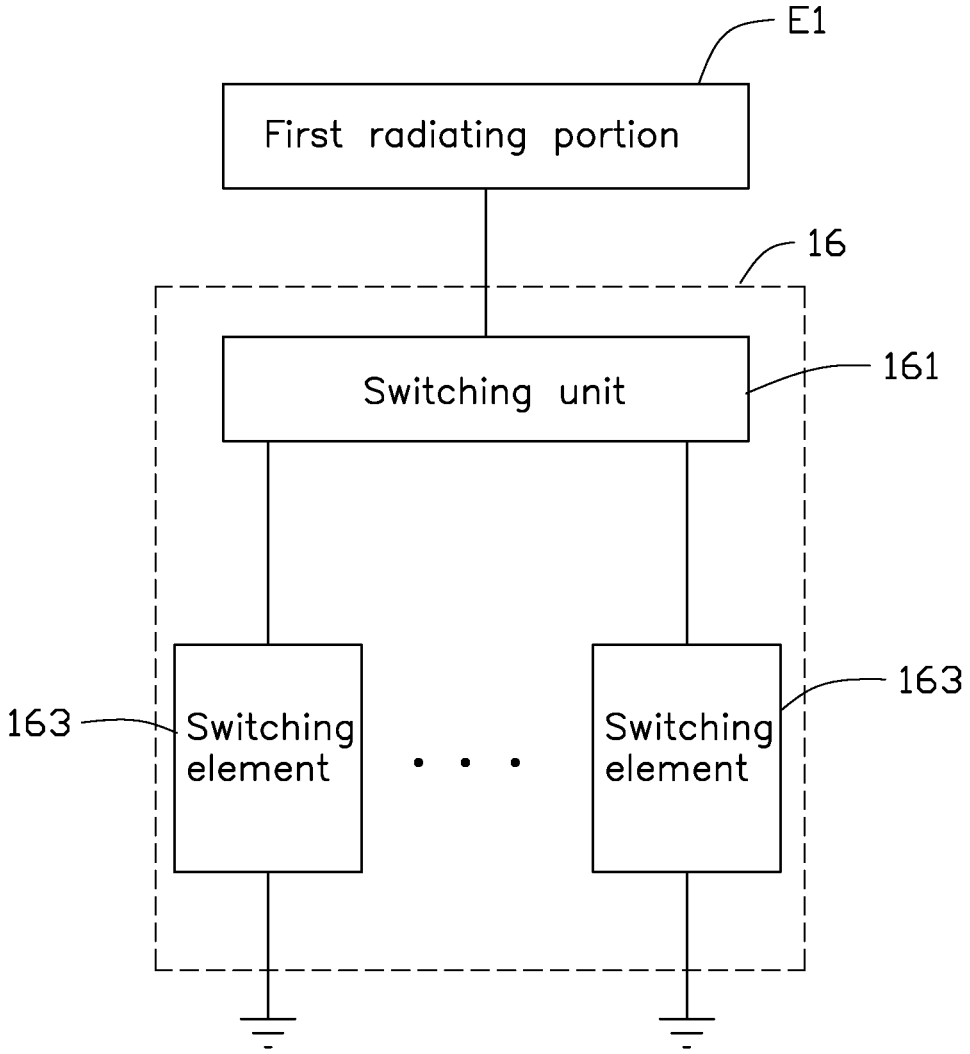
FIG. 3 is a circuit diagram of a switching circuit of the electronic device of FIG. 1.

As illustrated in FIG. 3, the switching circuit 16 includes a switching unit 161 and a plurality of switching elements 163. The switching unit 161 is electrically connected to the first radiating portion E1. Each switching elements 163 can be an inductor, a capacitor, or a combination of the inductor and the capacitor. The switching elements 163 are connected in parallel. One end of each switching element 163 is electrically connected to the switching unit 161. The other end of each switching element 163 is grounded. Through controlling the switching unit 161, the first radiating portion E1 can be switched to connect with different switching elements 163. Since each switching element 163 has a different impedance, the first frequency band of the first radiating portion E1 can be adjusted through switching the switching unit 161.

In this exemplary embodiment, since the first radiating portion E1 and the second radiating portion E2 are both made of metallic material, and are spaced apart from each other through the groove 121. The first radiating portion E1 and the second radiating portion E2 may be equivalent to two electrodes and generate a corresponding electric field, thereby forming a corresponding inductive capacitance between the first radiating portion E1 and the second radiating portion E2. When an object, for example, fingers of the user shield the groove 121, the object blocks the electric field to change the inductive capacitance between the two electrodes. Then, through sensing a change of the inductive capacitance between the first radiating portion E1 and the second radiating portion E2, the groove 121 can serve as a virtual key for triggering a corresponding function.

Figure 4:
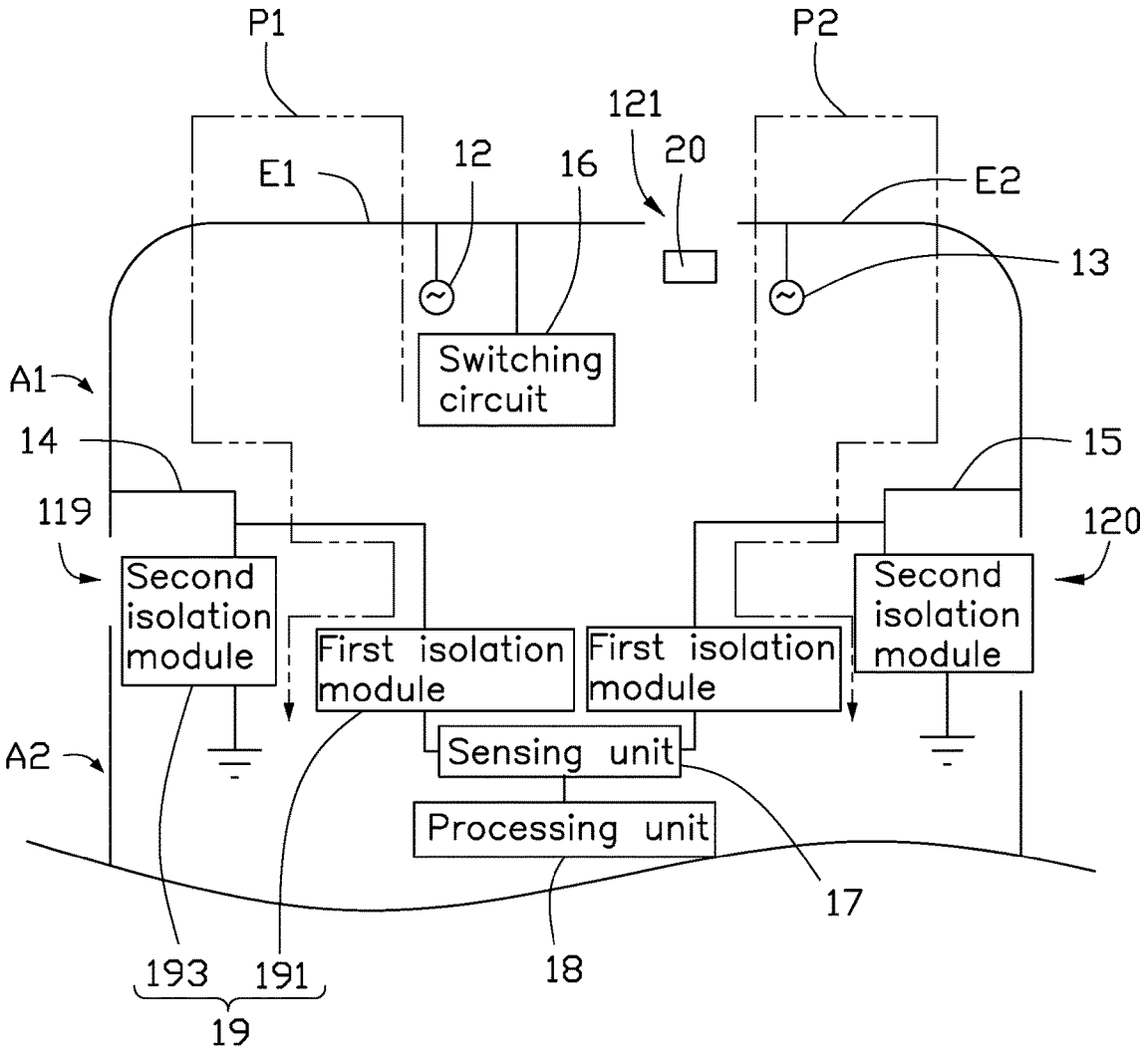
FIG. 4 is a transmission path graph of a first signal of the electronic device of FIG. 1.

As illustrated in FIG. 4, in this exemplary embodiment, the electronic device 100 further includes a sensing unit 17 and a processing unit 18. The sensing unit 17 is electrically connected to the first radiating portion E1 and the second radiating portion E2. The sensing unit 17 senses a change of the inductive capacitance between the first radiating portion E1 and the second radiating portion E2. The sensing unit 17 outputs a sensing signal according to the change of the inductive capacitance. The processing unit 18 is electrically connected to the sensing unit 17. The processing unit 18 receives the sensing signal from the sensing unit 17 and performs a corresponding function according to the sensing signal.

When the first radiating portion E1 and the second radiating portion E2 of the first portion A1 are served as the antenna structure 100, the first radiating portion E1 and the second radiating portion E2 receive and/or transmit a first signal. When the first radiating portion E1 and the second radiating portion E2 of the first portion A1 serve as the two electrodes generating the inductive capacitance, the sensing unit 17 receives and/or transmits a second signal through the first radiating portion E1 and the second radiating portion E2. The second signal activates the first radiating portion E1 and the second radiating portion E2 to generate the electric field and the inductive capacitance. In this exemplary embodiment, the first signal is a radio frequency (RF) signal, that is, the signal of the first frequency band and the second frequency band. The second signal is a low frequency pulse signal. A frequency of the second signal is lower than a frequency of the first signal.

Figure 5:
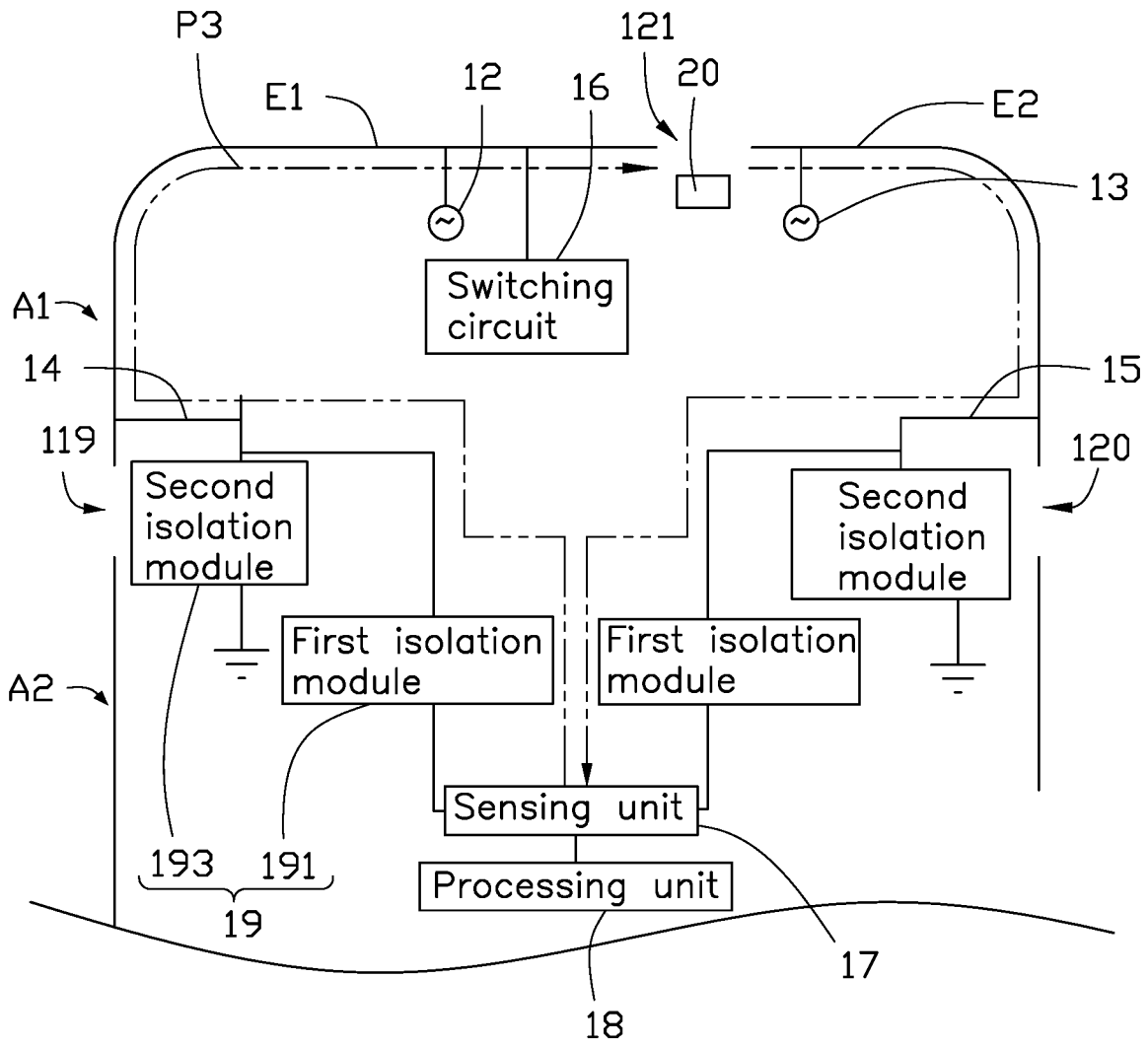
FIG. 5 is a transmission path graph of a second signal of the electronic device of FIG. 1.

As illustrated in FIG. 4 and FIG. 5, the electronic device 100 further includes a signal isolation unit 19 for preventing the first signal and the second signal from interfering with each other.

In this exemplary embodiment, the signal isolation unit 19 includes two first isolation modules 191 and two second isolation modules 193. One end of one first isolation module 191 is electrically connected to the first radiating portion E1 through the first ground portion 14. Another end of one first isolation module 191 is electrically connected to the sensing unit 17. One end of the other first isolation module 191 is electrically connected to the second radiating portion E2 through the second ground portion 15. Another end of the other first isolation module 191 is electrically connected to the sensing unit 17.

One end of one second isolation module 193 is electrically connected to the first radiating portion E1 through the first ground portion 14. Another end of one second isolation module 193 is electrically connected to the ground system of the electronic device 100 to be grounded. One end of the other second isolation module 193 is electrically connected to the second radiating portion E2 through the second ground portion 15. Another end of the other second isolation module 193 is electrically connected to the ground system of the electronic device 100 to be grounded.

In this exemplary embodiment, the first isolation module 191 can allow the second signal to pass through and block the first signal. The second isolation module 193 can allow the first signal to pass through and block the second signal. For example, the first isolation module 191 may be a low pass filter and the second isolation module 193 may be a high pass filter.

As illustrated in FIG. 4, when the electronic device 100 uses the housing 11 to receive and/or transmit the first signal, that is, the RF signal, the radiation signals of the first frequency band of the first signal flows through the first feed source 12, the first radiating portion E1, and the first ground portion 14. Then the first isolation module 191 is equivalent to an open end. The radiation signals of the first frequency band of the first signal is grounded through the second isolation module 193, that is, block the second signal and allow the radiation signals of the first frequency band of the first signal to pass, thereby forming a first path P1 and preventing the second signal from interfering the radiation signals of the first frequency band.

The radiation signals of the second frequency band of the first signal flows through the second feed source 13, the second radiating portion E2, and the second ground portion 15. Then the first isolation module 191 is equivalent to an open end. The radiation signals of the second frequency band of the first signal is grounded through the second isolation module 193, that is, block the second signal and allow the radiation signals of the second frequency band of the first signal to pass, thereby forming a second path P2 and preventing the second signal from interfering the radiation signals of the second frequency band.

As illustrated in FIG. 5, when the electronic device 100 uses the housing 11 to receive and/or transmit the second signal, that is, the low frequency pulse signal, the sensing unit 17, one first isolation module 191, the first ground portion 14, the first radiating portion E1, the second radiating portion E2, the second ground portion 15, and the other first isolation module 191 cooperatively form a third path P3. The sensing unit 17 then receives and/or transmits the second signal through the third path P3. The two second isolation modules 193 form an open circuit to prevent the first signal from interfering the second signal.

As described above, the electronic device 100 includes the housing 11 and the housing 11 is divided into the first radiating portion E1 and the second radiating portion E2 through the slot 118, the first gap 119, the second gap 120, and the groove 121. The first radiating portion E1 and the second radiating portion E2 are together served as an antenna structure of the electronic device 100, so that the electronic device 100 can effectively achieve a broadband design. Additionally, the first radiating portion E1 and the second radiating portion E2 are spaced apart from each other by the groove 121, and then can serve as two electrodes generating an inductive capacitance, so that the electronic device 100 can perform a virtual key function based on the inductive capacitance.

In other exemplary embodiments, the electronic device 100 can achieve other function through a space of the groove 121. For example, the electronic device 100 can further include a light-emitting element 20. The light-emitting element 20 is positioned inside the housing 11 and is aligned with the groove 121. Then the light emitted by the light-emitting element 20 can pass through the groove 121. In other exemplary embodiments, when the groove 121 is filled with insulating material, for example, plastic, rubber, glass, wood, ceramic, or the like, the insulating material can be transparent to allow the light emitted from the light-emitting element 20 to be transmitted from the groove 121.

The embodiments shown and described above are only examples. Many details are often found in the art such as the other features of the electronic device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An electronic device comprising:

a housing, the housing defining a slot and a groove, the groove communicating with the slot;

wherein the housing is divided into at least a first radiating portion and a second radiating portion by the slot and the groove, the first radiating portion is spaced apart from the second radiating portion, the first radiating portion and the second radiating portion cooperatively serve as an antenna structure of the electronic device to receive and/or transmit wireless signals; and wherein the electronic device further performs a virtual key function through the groove.

2. The electronic device of claim 1, wherein the housing further defines a first gap and a second gap, the first gap and the second gap both communication with the slot, the housing is divided into a first portion and a second portion through the first gap, the second gap, and the slot, the first portion is spaced apart from the second portion, the second portion is grounded; wherein the groove is defined on the first portion to divide the first portion into the first radiating portion and the second radiating portion.

3. The electronic device of claim 2, wherein the slot, the first gap, the second gap, and the groove are all filled with insulating material.

4. The electronic device of claim 2, wherein the housing comprises a front frame, a backboard, and a side frame, the side frame is positioned between the front frame and the backboard, the side frame is positioned around a periphery of the front frame and a periphery of the backboard, the slot is defined at the side frame, the first gap, the second gap, and the groove are all defined at the front frame.

5. The electronic device of claim 4, wherein a first portion of the front frame between the first gap and the groove forms the first radiating portion, a second portion of the front frame between the second gap and the groove forms the second radiating portion, the electronic device further comprises a first feed source, a second feed source, a first ground portion, and a second ground portion, the first radiating portion is grounded through the first ground portion, the second radiating portion is grounded through the second ground portion, the first feed source is electrically connected to the first radiating portion, and the second feed source is electrically connected to the second radiating portion.

6. The electronic device of claim 5, wherein when the first feed source outputs current, the current flows through the first radiating portion and is grounded through the first ground portion so that the first radiating portion activates a first operation mode to generate radiation signals in a first frequency band; wherein when the second feed source outputs current, the current flows through the second radiating portion and is grounded through the second ground portion so that the second radiating portion activates a second operation mode to generate radiation signals in a second frequency band; and wherein a frequency of the first frequency band is lower than a frequency of the second frequency band.

7. The electronic device of claim 6, further comprising a switching circuit, wherein the switching circuit comprises a switching unit and a plurality of switching elements, the switching unit is electrically connected to the first radiating portion, the switching elements are connected in parallel, one end of each switching element is electrically connected to the switching unit, and another end of each switching element is grounded, through controlling the switching unit to switch, the first radiating portion is switched to different switching elements so that the first frequency band is adjusted.

8. The electronic device of claim 4, wherein the front frame, the backboard, and the side frame cooperatively form the housing of the electronic device.

9. The electronic device of claim 1, further comprising a sensing unit and a processing unit, wherein the sensing unit is electrically connected to the first radiating portion and the second radiating portion, the sensing unit senses a change of an inductive capacitance between the first radiating portion and the second radiating portion, and outputs a sensing signal according to the change of the inductive capacitance; wherein the processing unit is electrically connected to the sensing unit, the processing unit receives the sensing signal from the sensing unit and performs the virtual key function according to the sensing signal.

10. The electronic device of claim 9, further comprising two first isolation modules and two second isolation modules, wherein one first isolation module is electrically connected between the first radiating portion and the sensing unit, the other first isolation module is electrically connected between the second radiating portion and the sensing unit; wherein one second isolation module is electrically connected between the first radiating portion and a ground, the other second isolation module is electrically connected between the second radiating portion and the ground.

11. The electronic device of claim 10, wherein when the electronic device uses the first radiating portion and the second radiating portion to receive and/or transmit a first signal, the two first isolation modules block the first signal and the two second isolation modules allow the first signal to pass; when the electronic device uses the first radiating portion and the second radiating portion as two electrodes generating the inductive capacitance, the sensing unit receives and/or transmits a second signal, the two second isolation modules block the second signal and the two first isolation modules allow the second signal to pass, and the second signal activates the first radiating portion and the second radiating portion to generate an electric field and the inductive capacitance, a frequency of the first signal is higher than a frequency of the second signal.

12. The electronic device of claim 1, further comprising a light-emitting element, wherein the light-emitting element is positioned inside the housing and is aligned with the groove, so that light emitted by the light-emitting element passes through the groove.

13. An electronic device comprising:

a housing, the housing defining a slot and a groove, the groove communicating with the slot;

wherein the housing is divided into at least a first radiating portion and a second radiating portion by the slot and the groove, the first radiating portion is spaced apart from the second radiating portion, the first radiating portion and the second radiating portion cooperatively serve as an antenna structure of the electronic device to receive and/or transmit wireless signals, the first radiating portion and the second radiating portion serve as two electrodes generating an inductive capacitance, and the electronic device performs a virtual key function based on the inductive capacitance.

14. The electronic device of claim 13, wherein the housing further defines a first gap and a second gap, the first gap and the second gap both communication with the slot, the housing is divided into a first portion and a second portion through the first gap, the second gap, and the slot, the first portion is spaced apart from the second portion, the second portion is grounded; wherein the groove is defined on the first portion to divide the first portion into the first radiating portion and the second radiating portion.

15. The electronic device of claim 14, wherein the housing comprises a front frame, a backboard, and a side frame, the side frame is positioned between the front frame and the backboard, the side frame is positioned around a periphery of the front frame and a periphery of the backboard, the slot is defined at the side frame, the first gap, the second gap, and the groove are all defined at the front frame.

16. The electronic device of claim 15, wherein a first portion of the front frame between the first gap and the groove forms the first radiating portion, a second portion of the front frame between the second gap and the groove forms the second radiating portion, the electronic device further comprises a first feed source, a second feed source, a first ground portion, and a second ground portion, the first radiating portion is grounded through the first ground portion, the second radiating portion is grounded through the second ground portion, the first feed source is electrically connected to the first radiating portion, and the second feed source is electrically connected to the second radiating portion.

17. The electronic device of claim 16, wherein when the first feed source outputs current, the current flows through the first radiating portion and is grounded through the first ground portion so that the first radiating portion activates a first operation mode to generate radiation signals in a first frequency band; wherein when the second feed source outputs current, the current flows through the second radiating portion and is grounded through the second ground portion so that the second radiating portion activates a second operation mode to generate radiation signals in a second frequency band; and wherein a frequency of the first frequency band is lower than a frequency of the second frequency band.

18. The electronic device of claim 16, further comprising a switching circuit, wherein the switching circuit comprises a switching unit and a plurality of switching elements, the switching unit is electrically connected to the first radiating portion, the switching elements are connected in parallel, one end of each switching element is electrically connected to the switching unit, and another end of each switching element is grounded, through controlling the switching unit to switch, the first radiating portion is switched to different switching elements so that the first frequency band is adjusted.

19. The electronic device of claim 13, further comprising a sensing unit and a processing unit, wherein the sensing unit is electrically connected to the first radiating portion and the second radiating portion, the sensing unit senses a change of the inductive capacitance and outputs a sensing signal according to the change of the inductive capacitance; wherein the processing unit is electrically connected to the sensing unit, the processing unit receives the sensing signal from the sensing unit and performs the predetermined function according to the sensing signal.

20. The electronic device of claim 19, further comprising two first isolation modules and two second isolation modules, wherein one first isolation module is electrically connected between the first radiating portion and the sensing unit, the other first isolation module is electrically connected between the second radiating portion and the sensing unit; wherein one second isolation module is electrically connected between the first radiating portion and a ground, the other second isolation module is electrically connected between the second radiating portion and the ground; wherein when the electronic device uses the first radiating portion and the second radiating portion to receive and/or transmit a first signal, the two first isolation modules block the first signal and the two second isolation modules allow the first signal to pass; when the first radiating portion and the second radiating portion serve as the two electrodes generating the inductive capacitance, the sensing unit receives and/or transmits a second signal, the two second isolation modules block the second signal and the two first isolation modules allow the second signal to pass, and the second signal activates the first radiating portion and the second radiating portion to generate an electric field and the inductive capacitance, a frequency of the first signal is higher than a frequency of the second signal.

* * * * *